United States Patent [19]

Saddler

[11] Patent Number: 4,951,952

[45] Date of Patent: Aug. 28, 1990

[54] AUTOMATIC PULSE TONE ARROW

[75] Inventor: Michael E. Saddler, 9 Royal St., RRI Box 197, N. Bennington, Vt. 05257

[73] Assignee: Michael Earl Saddler, N. Bennington, Vt.

[21] Appl. No.: 264,787

[22] Filed: Oct. 31, 1988

[51] Int. Cl.[5] ..... F42B 6/04

[52] U.S. Cl. ..... 273/416

[58] Field of Search ..... 273/416, 419, 420, 421, 273/422, 418

[56] References Cited

U.S. PATENT DOCUMENTS

| | | | |
|---|---|---|---|
| 3,066,940 | 12/1962 | De Lonais | 273/418 |
| 4,340,930 | 7/1982 | Carissimi | 273/416 X |
| 4,421,319 | 12/1983 | Murphy | 273/416 |
| 4,579,348 | 4/1986 | Jones | 273/421 |
| 4,729,320 | 3/1988 | Whitten, III. | 273/418 X |
| 4,749,198 | 6/1988 | Brailean | 273/416 |

*Primary Examiner*—Paul E. Shapiro

[57] ABSTRACT

A hunting or target arrow comprising of a shaft, fletching, and specially designed plunger type arrow head that after impact will automatically activate a sound emitting device. The foremost tip of the arrow head which is slidable extends slighty from its main body, being the normally open circuit position. At impact the tip slides into the main body which houses the energy source and closes the electrical circuit which in turn activates the sound emitting device at the rear of the arrow shaft.

1 Claim, 1 Drawing Sheet

AUTOMATIC PULSE TONE ARROW

BACKGROUND OF THE INVENTION

This invention relates to an arrow, target or hunting that makes it posible to be found by means of an audible device.

Bow and arrow shooting is an extremly popular sport. Equipment for the sport is constantly becoming more safisticated. However, both types of archers whether its the hunter or the range shooter still have one problem in common; losing arrows. I don't know which is worse, spending all day looking for your arrows or buying new ones. Either way I have invented an arrow which will solve this problem.

My solution to this problem is the development of the automatic pulse tone arrow. Using a standard aluminum arrow I have modified it to emit a pulsating beep after it has penatrated any surface. It will continue to beep at 5 second intervals until it is withdrawn from its target.

SUMMARY OF INVENTION

There is one other type of arrow that has a sound tracking device disclosed in Murphy 4,421,319. However Murphy uses a delay switch which has to be activated by the shooter before releasing the arrow. This could result in lose of game if the arrow was activated and the hunter waited more than 2½ minutes before shooting. The beeper would go off and frighten the game away. My arrow has no buttons to push or time limit to shoot. Its activated only after it strikes its target.

Another drawback to Murphys arrow design is the placement of the battery. With the weight in the rear the flight could possibly be affected. My arrow has the weight in the front which keeps the arrow in better balance. Murphy also uses an led light which not only adds weight to the rear of the arrow but it also could freighten game away if sited.

The activating button on Murphys arrow also posses a possible problem with the arrows flight, catching air and defracting the arrows path.

DESCRIPTION OF THE PREFERRED EMBODIMENT

Figure 1:
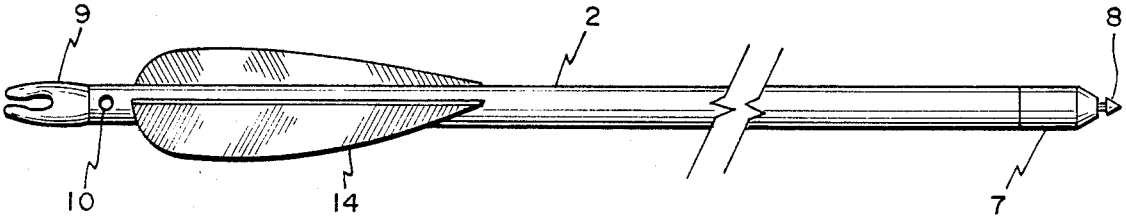
FIG. 1 is a overall perspective view of the arrow and where its components are.

FIG. 1 shows the full view of the pulsetone arrow. It is a standard arrow shaft 2, flething 14, and nock 9. The arrow head tip 7, plunger 8, and tone hole 10 are the only exterior changes from a standard arrow.

Figure 2:
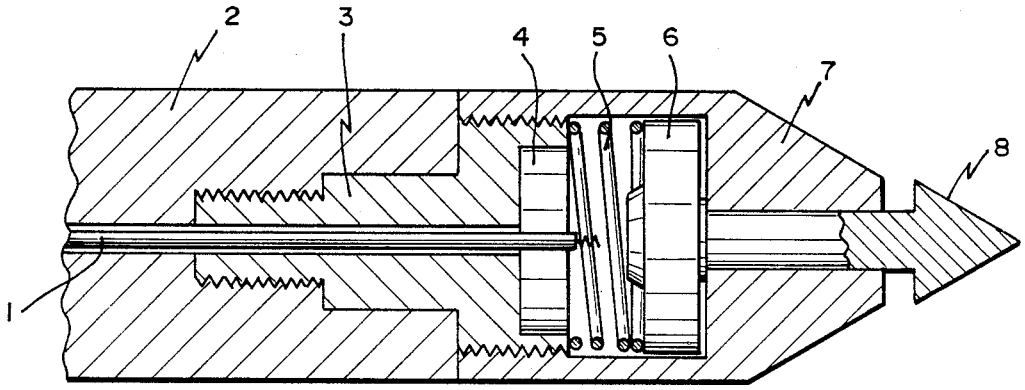
FIG. 2 is an enlarged view off the arrowhead which shows the working parts of the plunger, battery and contacts.

FIG. 2 shows the specially designed arrow head has a plunger 8 which is housed in the arrow head tip 7. The plunger (after target contact) pushes inward which inturn pushes the battery 6 until it makes contact with the negative wire 1. The plunger 8 stays inward until withdrawn from target. The pressure from the target holds arrow and plunger 8 in place (in the on position). The arrow head tip 7 encases the spring 5, battery 6 and holds the plunger 8. The head tip 7 screws onto the arrow head base 3.

The arrow head base 3 screws into a standard arrow shaft 2. It will be fixed into place with adhesive so it will be locked onto the shaft 2. The head base 3 is threaded on the opposite end so the arrow head tip 7 can be screwed on.

The shielded contact 4 is to keep the contact from the negative wire 1 from grounding out. The spring 5 keeps the battery away from the contact keeping the arrow in the off position. The battery 6 is a hearing aid type.

Figure 3:
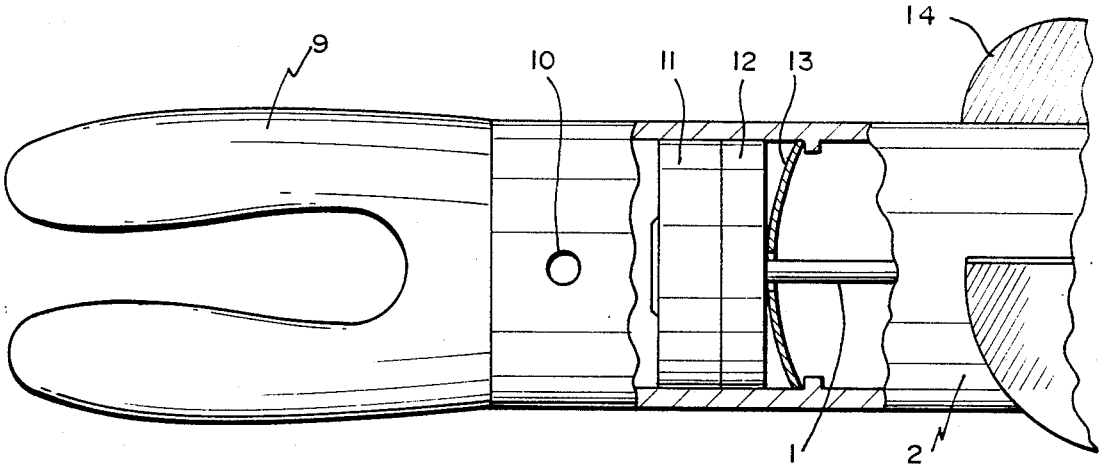
FIG. 3 is an enlarged view which shows the tail section of the arrow which houses the micro chip and buzzer system.

FIG. 3 shows the negative wire 1 running through the arrow shaft 2 and being attached to the micro chip 12. The micro chip gives the buzzer the tone and activates the buzzer 11 at 5 second intervals. The delay is to maximize battery life. The piezo type buzzer 11 is a small audible alarm similar to a watch type.

The spring clip 13 holds the buzzer 11 and micro chip 12 in place. It also grounds the micro chip to the shaft.

The beeping tones are emitted from a small hole 10 at the rear of the arrow.

What is claimed is:

1. A sound emitting arrow to enable tracking of lost arrows or game shot therewith, said arrow comprising;

(a) an arrow shaft, (b) a nock secured to the rear end of said arrow shaft, (c) a head secured to the front end of said arrow shaft, said head comprising a main body portion with hollow interior chamber and a bore extending forwardly from said chamber to the forward extent of the main body, a tip assembly slidably received on the forward portion of said main body portion comprising a forwardmost tip and a rearwardly extinding shank, said shank being slidably received in said bore, with said forwardmost tip normally spaced forwardly of the main body, (d) a battery having opposite electrical poles normally located in a forward portion of said chamber and positioned in alignment with the bore, (e) a first electrical contact projecting into said chamber and in alignment behind and spaced from one of said battery electrical poles, (f) spring means for normally biasing said battery forwardly in said chamber out of contact with said first contact but permitting said battery to be moved rearwardly in said chamber with said one electrical pole in contact with said first contact, (g) means for emitting sound when electrically energized located in the rear of said arrow shaft, and (h) means forming a series electrical path between said first contact, said sound emitting means and the other of said battery electrical poles, whereby when said arrow penetrates said target said tip is pushed rearwardly relative to said body causing said shank to push said battery rearwardly in said chamber, moving said one battery electrical contact into contact with said first contact thus forming a complete electrical circuit energizing said sound emitting means.

* * * * *